US008025093B2

(12) United States Patent
Morishita

(10) Patent No.: US 8,025,093 B2
(45) Date of Patent: Sep. 27, 2011

(54) PROCESS FOR MANUFACTURING CAST ALUMINUM ALLOY PLATE

(75) Inventor: Makoto Morishita, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 257 days.

(21) Appl. No.: 12/162,737

(22) PCT Filed: Feb. 6, 2007

(86) PCT No.: PCT/JP2007/052040

§ 371 (c)(1),
(2), (4) Date: Jul. 30, 2008

(87) PCT Pub. No.: WO2007/102290

PCT Pub. Date: Sep. 13, 2007

(65) Prior Publication Data

US 2009/0173470 A1 Jul. 9, 2009

(30) Foreign Application Priority Data

Mar. 8, 2006 (JP) ..... 2006-063050

(51) Int. Cl.
*B22D 11/06* (2006.01)

(52) U.S. Cl. ..... 164/480; 164/428

(58) Field of Classification Search ..... 164/480, 164/428

See application file for complete search history.

(56) References Cited

U.S. PATENT DOCUMENTS

| | | | | |
|---|---|---|---|---|
| 4,929,421 | A * | 5/1990 | Jin et al. | 420/545 |
| 2002/0084056 | A1* | 7/2002 | Hoffmann et al. | 164/480 |
| 2007/0217943 | A1* | 9/2007 | Zhao et al. | 420/534 |

FOREIGN PATENT DOCUMENTS

| | | | |
|---|---|---|---|
| EP | 0 281 238 | A1 * | 9/1988 |
| EP | 1 842 935 | A1 | 10/2007 |
| JP | 1-202345 | | 8/1989 |
| JP | 01 202345 | | 8/1989 |

(Continued)

OTHER PUBLICATIONS

Mueller, H. R., "Continuous Casting, Proceedings of the International Conference on Continuous Casting of Non-Ferrous Metals", DGM2005, Deutsche Gesellschaft Fuer Materialkunde E. V., pp. 86-94, (2005).

(Continued)

*Primary Examiner* — Kevin P Kerns

(74) *Attorney, Agent, or Firm* — Oblon, Spivak, McClelland, Maier & Neustadt, L.L.P.

(57) ABSTRACT

A twin-roll continuous casting method that controls occurrence of casting defects in a center part of plate thickness, for Al—Mg series aluminum alloy, a material featuring a wide temperature range for solid and liquid phases coexistence. In the method of manufacturing an Al—Mg series aluminum alloy cast plate, the plate contains Mg in a predetermined amount and has a relatively thick plate size, while casting is performed by a twin-roll type continuous casting method. Twin rolls have a roll diameter, and the rolls have a circumferential velocity. The circumferential length from points where molten metal starts contact with the rolls to kiss points is a solidification distance, and the roll gap at the kiss points is equal to the thickness of the cast plate. Specific relations among the above factors are maintained, and the continuous casting operation is carried out while satisfying such relations.

4 Claims, 1 Drawing Sheet

FOREIGN PATENT DOCUMENTS

| | | | |
|---|---|---|---|
| JP | 07 252571 | | 10/1995 |
| JP | 7-115131 | | 12/1995 |
| JP | 7-115132 | * | 12/1995 |
| JP | 08 165538 | | 6/1996 |
| JP | 2001-73058 | | 3/2001 |
| JP | 2001 234270 | | 8/2001 |
| RU | 2 203 767 | C2 | 5/2003 |
| WO | WO 03/018223 | A1 | 3/2003 |
| WO | WO 03/027345 | A1 | 4/2003 |
| WO | WO 03/052154 | A1 | 6/2003 |
| WO | WO 2005/103313 | A1 | 11/2005 |

OTHER PUBLICATIONS

"The Chemical Composition and State of Aluminum and Aluminum Alloy Products in China and Foreign Countries", Northeast Light Alloy Processing Factory, 1986, 6 pages.

* cited by examiner

PROCESS FOR MANUFACTURING CAST ALUMINUM ALLOY PLATE

TECHNICAL FIELD

This invention is intended to provide a method of manufacturing an aluminum alloy cast plate, which method can well control defects in the center part of the plate thickness, regardless if adapted to an Al—Mg series aluminum alloy plate having a wide solid and liquid phases coexistent temperature range or if applied to a twin roll continuous casting process where the twin rolls have a relatively large diameter and hence a relatively fast circumferential velocity.

BACKGROUND ART

As commonly known, a variety of aluminum alloy plate (hereinafter, aluminum may be referred to as "Al") has heretofore been used generally as members of framework and components for transport machinery such as automobiles, ships, airplanes, and trains; and for industrial machinery, electrical equipment, buildings, structures, optical apparatus, and other machines and instruments according to characteristics particular to respective alloys.

These aluminum alloy plates are used for the abovementioned members of framework and components, in most cases, after press molding or other forming processing. In this respect, the Al—Mg series Al alloys which are excellent in the balance of strength and ductility are advantageous in point of high-level formability as may be required.

For the above reason, studies have been made concerning component composition and optimization of manufacturing conditions with respect to Al—Mg series Al alloy plates. As Al—Mg series Al alloys, those shown in JIS A5052, 5182, etc., represent typical composition of alloy components. But, even these Al—Mg series Al alloys are poorer in ductility and hence inferior in formability when compared with the cold-rolled sheet steel.

There is a way for the Al—Mg series Al alloys to enhance the balance of strength and ductility, if the Mg content is increased and the alloy is made up to such a high-Mg alloy as over 3%. However, such a high-Mg Al—Mg alloy is difficult to industrially manufacture by the normal manufacturing method where the ingot cast by the direct chill casting process or the like is taken through soaking and then hot rolling. The reason for the difficulty is that in the direct chill casting in which large strain occurs to the ingot, the ingot is susceptible to fracture because the solid and liquid phases coexistent temperature range is extensive, and deep wrinkles deriving from the thick oxide film take place on the molten metal. Also, in the normal hot rolling, the Al—Mg alloy suffers from significant decrease in ductility, becoming liable to fracture.

On the other hand, it is also difficult to perform hot rolling of a high-Mg Al—Mg series alloy at a low temperature avoiding a high temperature region where the abovementioned fracture may happen. The reason for the difficulty is that in such a low temperature rolling, deformation resistance of the material, that is, a high-Mg Al—Mg series alloy, increases remarkably to the extent that the product sizes available become extremely limited due also to the capability of the current rolling machine.

As an attempt to increase acceptable Mg amount in a high-Mg Al—Mg series alloy, it is also proposed to add Fe, Si, or any other third element. But, if the content of such third element is increased, rough and large intermetallic compounds are likely to be easily formed to the effect of lowering ductility of the aluminum alloy plate. Therefore, there was a limit in increasing acceptable Mg amount, and in fact, it was difficult to get Mg contained in an amount of 8% or over.

Therefore, the idea of manufacturing a high-Mg Al—Mg series alloy plate by a twin-roll type continuous casting method and other methods has hitherto been proposed in quite a variety. In the twin-roll type continuous casting method, molten Al-alloy metal is poured from a molten metal supply nozzle made of refractory into between a pair of rotating water-cooled casting molds (twin rolls). The molten metal is thus solidified, and immediately after solidification, the metal is rapidly cooled between the twin rolls giving birth to aluminum alloy sheets. This twin-roll type continuous casting method described above and the 3C method are among those well known.

The cooling rate of the twin-roll type continuous casting method is higher by 1-3 digits than the conventional DC casting method and the belt type continuous casting method. Because of this fast rate, the aluminum alloy sheets obtained have a very fine metallic structure and excellent workability such as press-formability. Also by the casting method, the aluminum alloy sheets are thus available in a relatively thin thickness as 1-13 mm. This means that, just as the conventional direct chill ingot (200 to 600 mm thickness), the processes of hot rough rolling, hot finish rolling, etc., can be dispensed with. Further, the homogenization treatment of ingot may sometimes be omissible.

Various propositions have heretofore been made with regard to examples specifying metallic structures with the intention to enhance formability of the high-Mg Al—Mg series alloy sheets manufactured by the twin roll continuous casting method. For example, an aluminum alloy sheet of Al—Mg series containing as high Mg content as 6-10% and having excellent features in mechanical properties with the intermetallic compounds the average diameter of which is 10 μm or less, is proposed (see Patent Document 1). Another proposition refers to an aluminum alloy sheet used for automobile body sheets having 300 pieces/mm$^2$ or less of Al—Mg series intermetallic compounds of 10 μm or more, with average grain diameter ranging 10-70 μm. (see Patent Document 2).

With reference to 6000 series aluminum alloy, it was reported that casting of AA6016 aluminum alloy cast plates (1800W×1-2.5 mm thickness) was carried out by using the roll casting equipment called Speed Caster (see Non-patent Document 1).

[Patent Document 1] Japanese Patent Application Laid-open Publication No. 07-252571 (Scope of Claims pp. 1-2)

[Patent Document 2] Japanese Patent Application Laid-open Publication No. 08-165538 (Scope of Claims pp. 1-2)

[Non-patent Document 1] Continuous Casting, Proceedings of the International Conference on Continuous Casting of Non-Ferrous Metals, DGM2005, p 87

DISCLOSURE OF THE INVENTION

Problem to be Solved by the Invention

On the other hand, in case the high-Mg Al—Mg series alloy cast plates are manufactured by the twin roll continuous casting method, casting defects such as voids inside the plates are apt to occur, even if the circumferential velocity of the twin rolls are made faster in order to promote the production efficiency and the speedy mass-production. Voids are caused because the solidification temperature range of the high-Mg Al—Mg series alloy is rather wider as compared to the Al—Mg series alloy containing Mg in an amount less than 3%. Under such condition, any gas generated during pouring or solidification of molten metal, or otherwise any other gas convoluted from the ambiance becomes hard to be discharged from inside the cast metal to the outside, or in other words, tends to remain inside the cast metal structure, thus creating the voids mentioned above.

Voids inside the metallic structure, if developing excessively in the high-Mg Al—Mg series alloy plates, act on lowering elongation, and deteriorating strength-ductility balance, which makes the feature of the Al—Mg series alloy plate, and formability determined by that strength-ductility balance.

To cope with the above influences of the voids, some means like raising cooling rate of twin rolls, addition of a Ti-contained grain refiner, and so forth are certainly effective. However, these means have limitations if the casting defect such as void has to be controlled to the extent that the defect exerts little influence on elongation and other formability-related characteristics of the plate manufactured.

Accordingly, the fact was such that it could not be helped but to allow the casting defects such as voids to some extent, when a high-Mg Al—Mg series alloy cast plate was manufactured by the twin-roll continuous casting method.

The present invention has been made to solve the above-mentioned problems, and it has the object of providing a method of manufacturing an aluminum alloy cast plate, which method can well control defects in the center part of the plate thickness, regardless if adapted to a twin-roll continuous casting process for an Al—Mg series aluminum alloy plate having a wide solid and liquid phases coexistent temperature range.

Means for Solving the Problem

To attain the above object, used is a method of manufacturing an aluminum alloy cast plate with capability to control defects in the center part of the plate thickness. The summary of the method is as follows: an Al—Mg series aluminum alloy cast plate containing Mg in an amount of 3% by mass to 14% by mass is to be manufactured by a twin roll continuous casting method; in the method, when the roll diameter of the twin rolls is represented by D (m), the circumferential velocity by v (m/s), the circumferential length or the solidification length meaning the distance from the point where molten metal starts contact with the rolls to the kiss point is represented by s (m), and the thickness of the cast plate by d (m), continuous casting is to be carried out while satisfying the following two formulas: $v/D<0.3$ and $$\frac{\sqrt{(s/v)}}{(d/2)}$$

$>250$ (hereinafter sometimes expressed as $\sqrt{(s/v)}/(d/2)>250$).

Effect of the Invention

As described in the above summary, the present invention realizes control of defects in the center part of the plate thickness of the solidified cast plate (ingot in the shape of plate) by controlling the relation between the diameter and the circumferential velocity of the twin roll, and also the relation between the circumferential velocity of the twin roll and the plate thickness of the cast plate including other related matters, in place of the above solidification distance, or the roll gap (the distance between the kiss points 6 and 6 of the rolls).

Therefore, even if the velocity of the twin rolls may be made faster, or targeted production may be for an Al—Mg series aluminum alloy plate having a wide range of solid and liquid phases coexistent temperature, it is possible to control the defects in the center part of the thickness of the solidified cast plate.

As the result of the above, an Al—Mg series alloy cast plate containing a high Mg content of 3% or more can well be enhanced in elongation and in strength-ductility balance, also improving formability in such works as bulging, deep drawing, drilling, boring, blanking, or combination of any of these works.

When to manufacture the Al—Mg series aluminum alloy cast plate having a wide range of solid and liquid phases coexistent temperature, by the twin roll continuous casting method, it was already mentioned above, but casting defects such as voids are apt to occur particularly in the center part of the solidified cast plate. To cope with such casting defects, some means like raising cooling rate of twin rolls, addition of a Ti-contained grain refiner, and so forth are practiced, but only these means alone or even if any combination is made out of these means, there still exist significant limitations in controlling such casting defects as voids to the extent that the defects exert little influence on elongation and other formability-related characteristics of the plate manufactured.

EXPLANATION OF REFERENCE NUMERALS

Figure 1:
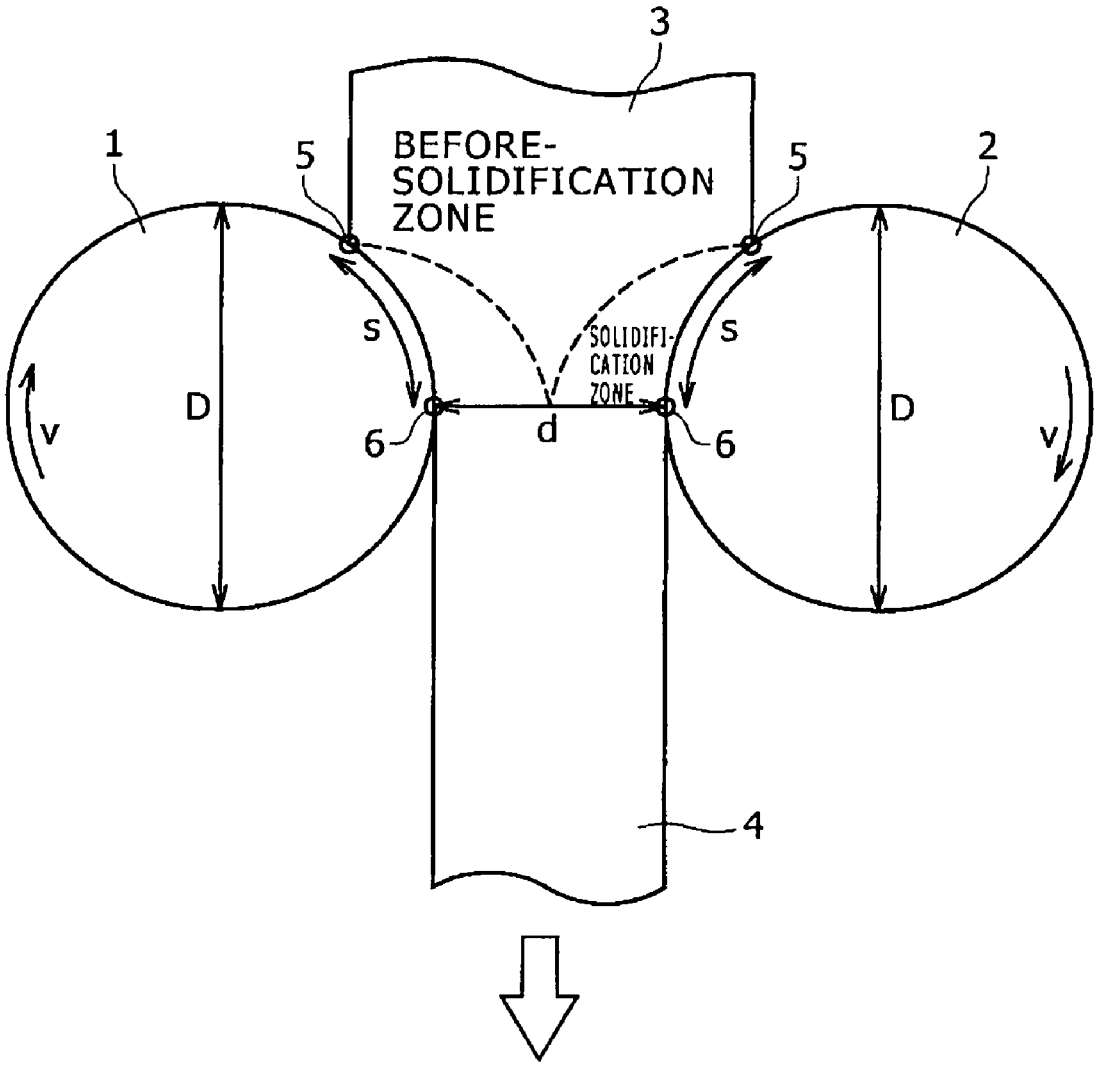
FIG. 1 is an explanatory drawing showing an embodiment of the twin-roll continuous casting method.

| | |
|---|---|
| 1, 2: | Twin rolls |
| 3: | Molten metal |
| 4: | Cast plate |
| 5. | The point from where molten metal 3 starts contact with the roll. |
| 6: | Kiss point |

BEST MODE FOR CARRYING OUT THE INVENTION

Hereinbelow, explanation is made more in detail item by item of the manufacturing method of the Al—Mg series aluminum alloy cast plate.

(Twin-Roll Continuous Casting Method)

FIG. 1 schematically shows the twin-roll continuous casting method. The twin-roll continuous casting is carried out in the following manner: the Al alloy molten metal 3 of the composition described above or below is poured through a molten metal supply nozzle made of refractory (not shown in the drawing) to between the twin rolls 1 and 2, a pair of rotating water-cooling copper casting mold; the molten metal is then solidified, cooled rapidly between the twin rolls 1 and 2, and made up to be the Al alloy cast plate 4.

As twin rolls suitable for better efficiency and mass production, the use of the twin rolls 1 and 2 in large diameter is preferable. The larger the diameter of the rolls are made, the faster the circumferential velocity v or the casting speed will become. For the sake of higher efficiency and mass production, it is preferable that the diameter D of the twin rolls should be made 0.1 ϕm or larger.

(Circumferential Velocity V)

As a premise in the present invention, it is preferable that the circumferential velocity v of the twin rolls 1 and 2 should be made slower (smaller). If the roll velocity v is made larger, it is apt to cause swirling current in the molten metal, which may lead to generation of voids and other casting defects. For this reason, it is preferable that the circumferential velocity v of the twin rolls 1 and 2 should be held below 0.3 m/s.

(v/D<0.3)

On the other hand, this swirling current in the molten metal leading to occurrence of casting defects such as voids is liable to come up in proportion to the circumferential velocity v and the distance of the gap between the rolls 1 and 2 (the distance of the gap on the upstream side of the rolls) just short of the kiss points 6 and 6 (on the upstream side), in the same way as the probability of occurrence of turbulent flow in an ordinary fluid is proportional to flow speed and width of flow path (speed×flow path width).

To avoid the above swirling current in the molten metal, [the circumferential velocity v×the distance of the gap between the rolls 1 and 2 on the upstream side of the rolls] must be made small. This distance of the gap between the rolls on the upstream side will become narrower in reverse proportion, if the roll diameter D is enlarged. Thus, by increasing the roll diameter D, it is possible to reduce the distance of the gap between the rolls on the upstream side.

From the foregoing, it is determined in the present invention that, in order to avoid the swirling current in the molten metal and reduce [the circumferential velocity v×the distance of the gap between the rolls 1 and 2 on the upstream side of the rolls], [the circumferential velocity v×1/roll diameter D], namely v/D, should be held small, that is, v/D should be kept below 0.3. According to the knowledge the inventors have obtained from testing, it can be said that, on the assumption of the roll diameter D of the twin rolls being 0.1 ϕm or over and the circumferential velocity v of the above twin rolls being 0.02 m/s or over, if v/D goes up to 0.3 or over, swirling current will be generated in the semi-solid molten metal between the twin rolls, making it difficult to obtain columnar crystal but permitting only to generate granular crystal entailing occurrence of casting defects, affected by a particular state of molten metal where cooling rate is extremely slow.

(√(s/V)/(d/2)>250)

It is well known that the thickness of the solidifying layer during casting is proportional to square root of the time in contact with the casting mold. In the case of twin-roll casting as in the present case, the time in contact with the casting mold can be expressed by s/V, where s denotes solidifying distance in FIG. 1, namely the circumferential length of the rolls from the points 5 and 5, from which the molten metal 3 starts contact with the rolls 1 and 2, up to the kiss points 6 and 6, and v denotes the circumferential velocity of the rolls.

When the above contact time expressed by √(s/v) is short, the solidification layer does not develop well and thus, is apt to leave imperfect solidification layer in the points 6 and 6, which may end up as casting defects. To control the defects deriving from the remaining imperfect solidification layer, the present invention is to define the relation between √(s/v) and the roll gap (the thickness of the casting plate) d at the kiss points 6 and 6 so that there may not remain any imperfect solidification layer.

According to the knowledge the inventors have obtained from the casting test, it has become clear that when the roll gap (the cast plate thickness) at the kiss points 6 and 6 is shown by d (m) and if √(s/v)/(d/2) is below 250, the solidification layer at the kiss points 6 and 6 may become thin and may keep some imperfect solidification layer remaining in the center part of the plate thickness. This tendency is intensified in case the circumferential velocity v of the twin rolls goes up to 0.02 m/s or over. Accordingly, the present invention makes it necessary to bring up the value of √(s/v)/(d/2) over 250, that is, √(s/V)/(d/2)>250.

(Thickness of Cast Plate)

As mentioned above, the present invention intends that no imperfect solidification layer in the center part of the plate thickness should be left at the kiss points 6 and 6 and that the molten metal should be brought to a complete solidification deep to the center of the thickness before it reaches the kiss points 6 and 6.

Therefore, the roll gap at the kiss points 6 and 6 becomes equal to the thickness of the cast plate. The present invention replaces the roll gap d (m) at the kiss points 6 and 6 with the plate thickness d (m) of the cast plate which is easier to measure, and specifies the above formula of √(s/V)/(d/2)>250. Additionally, the plate thickness of the cast plate is freely selected in the present invention.

(Other Twin-Roll Casting Conditions)

Explanation is given hereinbelow to the other preferred twin-roll casting conditions.

(Twin-Roll Casting Method)

The twin-roll casting method can be practiced either in horizontal style (twin rolls are set side by side vertically) or in vertical style (twin rolls are set side by side horizontally). However, the vertical style (twin rolls are set horizontally) shown in FIG. 1 is characterized in that the solidification distance can be set relatively large with prolonged contact time, thus enabling increased casting rate and enhanced productivity. In consideration of these points, whichever is suitable for the intended use, either vertical style or horizontal style of twin-roll casting, should be properly selected.

(Cooling Rate)

The twin-roll continuous casting has a merit in that casting can be performed at a much increased cooling rate in comparison with the belt caster method, propelti method, block caster method, and other casting methods. In the case of the twin-roll casting method, the same method that can be operated at a cooling rate of at least 50° C./s and higher, and preferably as rapid a cooling rate as possible. At a cooling rate less than 50° C./s, the average crystal grain of the cast plate is likely to coarsen at a level beyond 50 μm; at the same time, coarsening would occur to intermetallic compounds like Al—Mg series across-the-board, and possibility would become high in giving out a large amount of crystallization. This may result in deterioration of strength-elongation balance and considerable worsening of press formability. Also, homogeneity of the cast plate would be impaired.

The above cooling rate is hard to measure directly, but it can be obtained by using a publicly known method (introduced for instance in: "Aluminum Dendrite Arm Spacing and Measuring Method for Cooling Rate," published by the Japan Institute of Light Metals, Aug. 20, 1988; and other publications) on the basis of the dendrite arm spacing (DAS). To be more precise, the average spacing d between mutually adjoining dendrite secondary arms is measured by means of the line of intersection method (number of fields of vision: 3 or more; number of intersections: 10 or more); using this d, C is to be obtained from the following formula: $d=62\times C^{-0.337}$ (where d: dendrite secondary arms spacing (mm); C: cooling rate (° C./s)).

(Roll Lubrication)

In case a roll lubricant is used, it is likely to happen that the cooling rate may appear fast enough on theoretical computation but that substantive or actual cooling rate may stay below 50° C./s. For the twin rolls, therefore, it is desirable to use rolls with the surfaces not lubricated with a lubricant. In the past, in order to prevent solidification husk formed on the roll face from cracking due to contact of molten metal on the roll face or fast cooling, it was a generally exercised practice to apply oxidative powder (alumina powder, zinc oxide powder, etc.), SiC powder, graphite powder, oil, molten glass, and other lubricants (mold release agents) to the surface of the twin rolls by coating or flowing-down. However, use of a lubricant out of those listed above may reduce cooling rate resulting that the cooling rate can not come up to the required level.

Furthermore, use of these lubricants is apt to cause surface irregularity in concentration and thickness of the lubricant, leading to unevenness in cooling effect and to insufficient solidification rate depending on locations. For this reason, the higher is the Mg content, the larger the macro segregation and micro segregation become, which is likely to make it more difficult to keep equalized strength-ductility balance of the Al—Mg series alloy plate.

(Teeming Temperature)

The teeming temperature at which the molten alloy metal is poured to the twin rolls is not particularly limited but can be any temperature within the capability of the equipment, if at all it is over liquidus-line temperature.

(Manufacturing Method)

The Al—Mg series Al alloy cast plate according to the present invention after the twin-roll continuous casting process is usable as they are, but with necessary molding and forming processing, for members and parts of respective end-uses above-mentioned. The same cast plate can also be used as a cast plate provided with thermal refining such as homogenization thermal treatment and annealing, which plate is also included within the scope of the present invention. In addition, the cast plate can be manufactured as a rolled plate after processing through combinations of homogenization thermal treatment, cold rolling, annealing, and/or other treatments so that the processed cast plate as such can well be used also for members and parts of the respective end-uses described above.

(Chemical Composition)

Next, explanation is made of the chemical composition of the Al—Mg series Al alloy as follows. In view of the characteristics such as strength, ductility, and strength-ductility balance required for the cast plate, the chemical composition of the Al alloy cast plate (or the molten metal supplied to the twin rolls) according to the present invention should include Mg in an amount of 3% by mass to 14% by mass the rest being composed of Al and unavoidable impurities.

In the present invention, however, the above composition of the Al alloy cast plate includes some elements which easily get mixed in from dissolving metals like scrap metals (such elements are included in the above unavoidable impurities). The kinds of elements acceptable as such are listed as follows, along with the respective upper limits up to which these elements are allowed to be included in the composition (the upper limits are shown on the basis of percentage by mass): Fe: 1.0% or less; Si: 0.5% or less; Mn: 1.09% or less; Cr: 0.5% or less; Zr: 0.3% or less; V: 0.3% or less; Ti: 0.5% or less; B: 0.05% or less; Cu: 0.5% or less; and Zn: 0.5% or less. If these elements exceed the respective upper limits (allowable amount), compounds deriving from these elements might be created excessively to the extent of being very harmful to the characteristic of the Al alloy casted plate, such as fracture toughness and formability.

In the above-mentioned composition, Mg is an important alloy element which plays a role of enhancing strength, ductility, and strength-ductility balance of the Al—Mg series Al alloy casted plate. When the Mg content is 3% or less, there will be a shortage in strength and ductility. On the contrary, if the Mg content is over 14%, the Al—Mg compounds will increase in output of crystallization, even if cooling rate during continuous casting is increased, resulting in considerably deteriorated formability. At the same time, amount of work hardening will increase, and formability will be lowered. Accordingly, the Mg content needs to be kept within the range of from 3%, by mass or more to 14% by mass or less. Further, if a higher strength-ductility balance particular to the hi-Mg Al—Mg series Al alloy is required, the Mg content should preferably be held within the range of from 8% or more to 14% or less.

Besides, this Mg content has a particular meaning of limiting the Al—Mg alloy to the one which is made the target of the present invention, the one which features a wide temperature range for solid and liquid phases coexistence (solidification temperature range), and the one which has a temperature span of 25° C. or over from the liquidus-line temperature to the temperature at which the solid phase ratio reaches 0.8. As described above, the Al—Mg alloy which is made the target of the present invention is likely to cause casting defects such as voids, especially when large-diameter rolls are utilized, or when the circumferential velocity of the twin rolls is made faster. On the other hand, in case of the Al—Mg alloy in which the Mg content is less than 3% by mass, the temperature range for solid and liquid phases coexistence is narrow, and the temperature span from the liquidus-line temperature to the temperature at which the solid phase ratio reaches 0.8 is less than 25° C. In other words, the Al—Mg alloy in which the Mg content is less than 3% by mass is unlikely to cause casting defects such as voids, from the beginning.

Example

An example of the present invention is explained hereinbelow. Samples of Al—Mg series Al alloy cast plates, having various chemical compositions, as shown in Table 1 (Example: A to D; Comparative example: E), these samples having been produced by the twin-roll continuous casting. With respect to the chemical compositions of these Al alloy cast plates, elements contained in the plates but not shown in Table 1 were as follows (each shown on the basis of "% by mass"): Zr: 0.3% or less; V: 0.3% or less; and B: 0.05% or less.

As shown in Table 2, various sample cast plates, respectively in different thicknesses, were produced by twin-roll continuous casting method, with the machine types differentiated whether vertical style or horizontal style, and under variously different casting conditions; cooling was made down to room temperature. The cast plates were in the size of 300 mm width by 5 m length. Also, all the samples, including the comparative example for which cooling rate was set to be very slow, were produced by continuous casting and without application of any lubricant to the twin-rolls' surfaces to secure necessary cooling rate (no lubrication).

Test specimens were taken from each sample of the Al alloy cast plate produced in the manner described above, and in respect to each plate structure, mean area ratios of voids were measured respectively. The results thereof are also shown in table 2.

(Void)

The mean area ratio of voids was evaluated as passed, if the result was 0.5% or less, a level considered not affecting the elongation of the plate and other formability characteristics. The measuring method for the mean area ratio of voids was as follows: a test specimen taken from the sample of Al alloy cast plate was subjected to mechanical polishing, and then, observation was made of the cross-sectional structure of the center part of the plate with an optical microscope of 50× magnification. The image in the microscopic field was processed to differentiate areas having void defects from areas of normal structure, and the total area identifiable as occupied by voids in the image was obtained, and the ratio of such area of voids to the total area of the image was expressed in percentage as the area ratio of voids. In this regard, the above "mean area ratio" was defined as an average of "ratio of voids" values measured in any 10 places in the center part of the plate but excluding both the fore-end and back-end portions of the plate.

As shown in Table 2, the inventive examples 1 to 8 having the chemical compositions within the scope of the present invention cover the cast plates, each including Mg in an amount of from 3% by mass or over to 14% or less and having a thickness of 3 mm or over. The twin rolls have a roll diameter D of 0.1 ϕm or over, and the circumferential velocity of the twin rolls is set to be 0.02 m/s; and while making these settings, continuous casting with the twin rolls is carried out satisfying the following two formulas: $v/D<0.3$ and $\sqrt{(s/v)/(d/2)}>250$. This makes it possible to hold the mean area ratio of voids low and control internal defects.

Also, as shown in Table 2, the inventive examples 1-8 use mean cooling rate of 50° C./s or higher to get solidification reach the center part of the cast plate during twin-roll casting operation.

Compared to the above, the comparative examples 9-17 respectively have the chemical compositions within the scope of the present invention, but they fail to satisfy either or both of the two formulas of $v/D<0.3$ and $\sqrt{(s/V)/(d/2)}>250$. Consequently, this results in a large value for the mean area ratio of voids and insufficient control over internal defects.

Further, the comparative examples 18-20 shown for reference correspond to the alloy E in Table 1. The Mg content for these samples is less than 3%, and the temperature span from the liquidus-line temperature to the temperature at which the solid phase ratio reaches 0.8 is less than 25° C. Therefore, the alloy E or the comparative examples 18-20 stand outside the Al—Mg alloy which is made the target of the present invention and has the temperature span from the liquidus-line temperature to the temperature at which the solid phase ratio reaches 0.8 is 25° C. or over. For this reason, it is obvious that casting defects such as voids are quite unlikely to occur, no matter if the comparative example 18 can satisfy both of the formulas of $v/D<0.3$ and $\sqrt{(s/v)/(d/2)}>250$ and no matter if the comparative examples 19 and 20 cannot satisfy either one of the formulas.

From what has been described in the foregoing, it will be understood that the requirements and or preferred conditions specified in the present invention represent critical meaning for the purpose of reducing ratio of voids.

TABLE 1

| Category | | | | | | | | | | | | |
|---|---|---|---|---|---|---|---|---|---|---|---|---|
| | | Composition of Al Alloy Cast Plate (% by mass; remainder: Al) | | | | | | | | Temperature span from liquidus-line temperature to temperature at solid phase | Liquidus-line Temperature | |
| | Mark | Mg | Fe | Si | Ti | Mn | Cr | Cu | Zn | ratio 0.8 | ° C. | Remarks |
| Example | A | 10.0 | 0.015 | 0.015 | — | — | — | — | — | 63.7° C. | 608.7 | 10% Mg |
| | B | 8.0 | 0.015 | 0.015 | — | — | — | — | — | 50.4° C. | 619.4 | 8% Mg |
| | C | 4.75 | — | — | 0.03 | 0.43 | — | 0.11 | — | 32.2° C. | 637.2 | Equivalent to 5182 |
| | D | 4.0 | 0.015 | 0.015 | — | — | 0.06 | 0.05 | 0.15 | 26.0° C. | 640.0 | Equivalent to 5086 |
| Comparative example | E | 2.45 | — | — | 0.03 | 0.20 | 0.20 | — | — | 21.1° C. | 654.1 | Equivalent to 5052 |

* Content shown as "—" means "below measurable limits."

TABLE 2

| Category | | | | | | | | | | | | |
|---|---|---|---|---|---|---|---|---|---|---|---|---|
| | | | Twin-roll Continuous Casting Conditions | | | | | | | | Cast Plate | |
| | | Alloy | | Casting Temperature | Roll Diameter | Roll Circumferential Velocity | Cooling Rate at Ingot | Solidification Distance (s) | Parameter | | Area Ratio of | Plate Thickness (Thickness of Solidification |
| | Mark | Type | Style | ° C. | (D) Φm | (v) m/s | Center ° C./s | m | v/D | $\sqrt{(s/v)/(d/2)}$ | Voids % | d) m |
| Example | 1 | A | Vertical | 630 | 0.3 | 0.083 | 100 | 0.06 | 0.28 | 288 | 0.0 | 0.0059 |
| | 2 | A | Vertical | 630 | 0.3 | 0.083 | 50 | 0.06 | 0.28 | 288 | 0.0 | 0.0059 |
| | 3 | B | Vertical | 640 | 0.3 | 0.083 | 100 | 0.06 | 0.28 | 274 | 0.0 | 0.0062 |
| | 4 | C | Vertical | 660 | 0.3 | 0.083 | 100 | 0.06 | 0.28 | 262 | 0.0 | 0.0065 |
| | 5 | D | Vertical | 670 | 0.3 | 0.083 | 100 | 0.06 | 0.28 | 254 | 0.0 | 0.0067 |
| | 6 | C | Vertical | 660 | 0.6 | 0.167 | 100 | 0.06 | 0.28 | 261 | 0.0 | 0.0046 |
| | 7 | C | Vertical | 660 | 1.0 | 0.25 | 100 | 0.06 | 0.25 | 265 | 0.0 | 0.0037 |
| | 8 | C | Vertical | 660 | 1.0 | 0.0167 | 100 | 0.03 | 0.02 | 255 | 0.0 | 0.0105 |
| Comparative example | 9 | A | Vertical | 630 | 0.3 | 0.083 | 100 | 0.06 | 0.28 | 240 | 4.2 | 0.0071 |
| | 10 | A | Vertical | 630 | 0.3 | 0.167 | 100 | 0.06 | 0.56 | 245 | 4.6 | 0.0049 |
| | 11 | C | Vertical | 660 | 0.3 | 0.083 | 100 | 0.06 | 0.28 | 243 | 2.8 | 0.0070 |
| | 12 | C | Vertical | 660 | 0.3 | 0.167 | 100 | 0.06 | 0.56 | 255 | 2.6 | 0.0047 |
| | 13 | C | Vertical | 660 | 0.6 | 0.167 | 100 | 0.06 | 0.28 | 240 | 3.8 | 0.0050 |

TABLE 2-continued

| Category | | | | | | | | | | | |
|---|---|---|---|---|---|---|---|---|---|---|---|
| | | Twin-roll Continuous Casting Conditions | | | | | | | | Cast Plate | |
| | Alloy | | Casting Temperature | Roll Diameter | Roll Circumferential Velocity | Cooling Rate at Ingot | Solidification Distance (s) | Parameter | | Area Ratio of | Plate Thickness (Thickness of Solidification |
| Mark | Type | Style | ° C. | (D) Φm | (v) m/s | Center ° C./s | m | v/D | $\sqrt{(s/v)}/(d/2)$ | Voids % | d) m |
| 14 | C | Vertical | 660 | 0.6 | 0.25 | 100 | 0.06 | 0.42 | 265 | 1.2 | 0.0037 |
| 15 | C | Vertical | 660 | 1.0 | 0.25 | 100 | 0.06 | 0.25 | 245 | 1.5 | 0.0040 |
| 16 | C | Vertical | 660 | 1.0 | 0.367 | 100 | 0.06 | 0.37 | 253 | 0.7 | 0.0032 |
| 17 | C | Vertical | 660 | 1.0 | 0.02 | 100 | 0.03 | 0.02 | 233 | 3.9 | 0.0105 |
| 18 | E | Vertical | 660 | 0.6 | 0.167 | 100 | 0.06 | 0.28 | 261 | 0.0 | 0.0046 |
| 19 | E | Vertical | 660 | 0.3 | 0.167 | 100 | 0.06 | 0.56 | 255 | 0.0 | 0.0047 |
| 20 | E | Vertical | 680 | 0.3 | 0.083 | 100 | 0.06 | 0.28 | 233 | 0.0 | 0.0066 |

Industrial Applicability

As explained above, the present invention provides the method of manufacturing aluminum alloy casted plates that makes it possible to control occurrence of casting defects in the center part of plate thickness, even when the twin-roll continuous casting method is applied to processing of the Al—Mg series aluminum alloy, a material which features a wide temperature range for solid and liquid phases coexistence. As a result, the above aluminum alloy plates can expect much expanded application particularly in the usage areas where good formability is required, as framework members and components for transport machinery such as automobiles, ships, airplanes, and trains; and for industrial machinery, electrical equipment, buildings, structures, optical apparatus, and other machines and instruments.

The invention claimed is:

1. A method of manufacturing aluminum alloy cast plate substantially without voids, comprising the steps of:

arranging twin cooled casting rolls having diameters D (m) to have a spacing of d (m) between kiss points of the casting rolls;

supplying a molten Al—Mg series alloy including Mg in an amount of from 3% by mass or more to 14% by mass or less to the casting rolls;

rotating the casting rolls at a circumferential velocity v (m), whereby the molten alloy is solidified to form a cast plate of thickness d, without internal defects, over a solidification distance s equal to the circumferential length of the rolls starting from where molten alloy first touches the twin rolls up to the kiss points; and controlling v, D, s and d such that:

v/D<0.3 per second, and $$\frac{\sqrt{(s/v)}}{(d/2)}$$

>250 seconds per meter.

2. The method of manufacturing aluminum alloy cast plate substantially without voids, according to claim 1, wherein the rate of cooling by the twin rolls is made 50° C./s or over.

3. The method of manufacturing aluminum alloy cast plate substantially without voids, according to claim 1, wherein said aluminum alloy cast plate contains on the basis of % by mass, Fe: 1.0% or less, Si: 0.5% or less, Mn: 1.0% or less, Cr: 0.5% or less, Zr: 0.3% or less, V: 0.3% or less, Ti: 0.5% or less, B: 0.05% or less, Cu: 0.5% or less, and Zn: 0.5% or less.

4. The method of manufacturing aluminum alloy cast plate substantially without voids, according to claim 2, wherein said aluminum alloy cast plate contains on the basis of % by mass, Fe: 1.0% or less, Si: 0.5% or less, Mn: 1.0% or less, Cr: 0.5% or less, Zr: 0.3% or less, V: 0.3% or less, Ti: 0.5% or less, B: 0.05% or less, Cu: 0.5% or less, and Zn: 0.5% or less.

* * * * *